US005495626A

United States Patent [19]

Lindroos et al.

[11] Patent Number: 5,495,626

[45] Date of Patent: Mar. 5, 1996

[54] ELECTRICAL CONTROL DEVICE

[75] Inventors: Gunnar Lindroos, Helsingfors, Finland; Paul Wallström, Kristianstad, Sweden

[73] Assignee: Evac AB, Bromolla, Sweden

[21] Appl. No.: 228,139

[22] Filed: Apr. 15, 1994

[30] Foreign Application Priority Data

Apr. 19, 1993 [FI] Finland ..... 931757

[51] Int. Cl.[6] ..... E03D 11/10

[52] U.S. Cl. ..... 4/435; 4/431

[58] Field of Search ..... 4/316, 431, 432, 4/433, 434, 435, 436, 437, 438, 441, 442, DIG. 3, 321

[56] References Cited

U.S. PATENT DOCUMENTS

| | | | |
|---|---|---|---|
| 3,474,469 | 10/1969 | Steltz | 4/541.3 X |
| 3,956,776 | 5/1976 | Vanden Broek | 4/317 X |
| 4,032,822 | 6/1977 | Un | 4/DIG. 3 |
| 4,309,781 | 1/1982 | Lissau | 4/DIG. 3 |
| 4,357,719 | 11/1982 | Badger et al. | 4/316 |
| 4,678,879 | 7/1987 | Kenway | 200/296 |
| 4,713,847 | 12/1987 | Oldfelt et al. | 4/317 X |
| 4,865,631 | 9/1989 | Stroby et al. | 4/321 |
| 4,892,988 | 1/1990 | Ishii | 200/516 |
| 4,928,326 | 5/1990 | Olin et al. | 4/300 |
| 5,007,117 | 4/1991 | Oldfelt et al. | 4/432 |
| 5,133,853 | 7/1992 | Mattsson et al. | 210/104 |
| 5,214,807 | 6/1993 | Terve | 4/431 X |
| 5,245,711 | 9/1993 | Oldfelt et al. | 4/431 X |
| 5,317,763 | 6/1994 | Frank et al. | 4/434 |

FOREIGN PATENT DOCUMENTS

| | | |
|---|---|---|
| 83797 | 4/1990 | Finland . |
| 4134386 | 4/1992 | Germany . |

*Primary Examiner*—Robert M. Fetsuga
*Attorney, Agent, or Firm*—Smith-Hill and Bedell

[57] ABSTRACT

A vacuum sewer toilet system comprises a toilet compartment, a toilet bowl installed in the toilet compartment, a vacuum sewer, at least one electrically operated device for initiating an emptying and rinsing operation of the toilet bowl, and electrical components for controlling supply of operating current to the electrically operated device. The electrical components are incorporated in a control unit that is sealed against humidity and is protected against unauthorized human access. The control unit is mounted in the toilet compartment at a location that is spaced from the toilet bowl.

2 Claims, 3 Drawing Sheets

Fig. 2
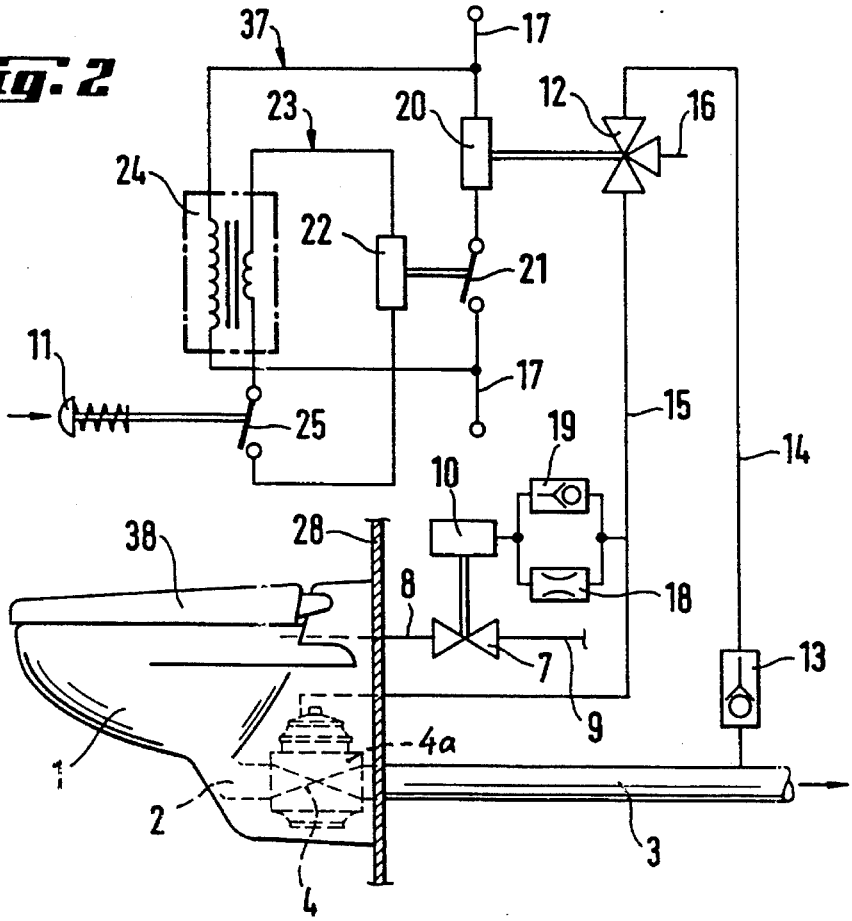
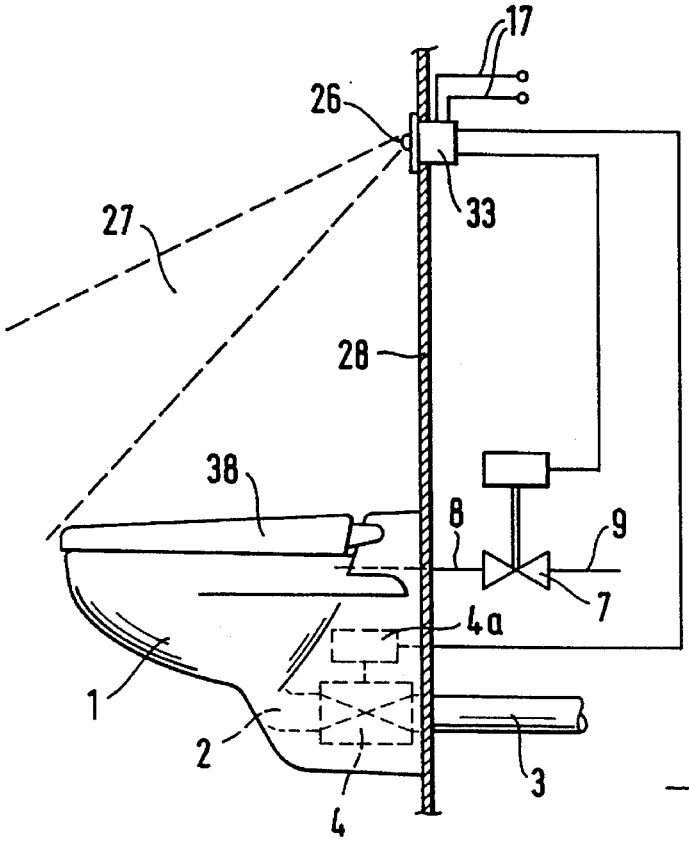
Fig. 3

ELECTRICAL CONTROL DEVICE

BACKGROUND OF THE INVENTION

This invention relates to a human-activated electrical device for initiating the emptying and rinsing operation of a vacuum sewer toilet system. In this specification, the term "vacuum" means partial vacuum.

The emptying and rinsing operation of a vacuum sewer toilet system is usually controlled pneumatically, that is, by means of the atmospheric pressure and vacuum. In such a system, both the rinse water supply valve, for supplying rinse water to the toilet bowl, and the sewer or discharge valve, connecting the toilet bowl to the vacuum sewer, are operable by means of vacuum to an open position. Preferably, the source of vacuum is the vacuum sewer itself, in which the pressure is only about one half atmospheric pressure, because it is then not necessary to provide a separate vacuum source and moreover the advantage is achieved that neither the emptying of the toilet bowl nor the supply of rinse water to the toilet bowl can be activated if there is not a sufficient vacuum in the vacuum sewer. Such a system also has the advantage that it avoids the use of electrical components in the toilet compartment and thereby avoids dangerous situations due to short circuits that might be caused by possible water leakages. Nevertheless, an electrically operated control system provides several advantages. In particular, an electrically operated control system is versatile and easy to control and usually takes very little space.

SUMMARY OF THE INVENTION

An object of the invention is to provide an electrical control device that is especially suitable for a vacuum sewer toilet and is so designed that it is easy to apply and use and in no respect can be of danger to the user.

According to the invention all electrical components of an electrical control system for a vacuum sewer toilet are located at a considerable distance from the toilet bowl and are well protected from moisture. This greatly reduces the risk of harm to the user.

The security of the device can be further improved by arranging all the elements of the device that may be touched by a person so that they are in contact only with low voltage electrical equipment. Preferably, the maximum voltage for such equipment is no more than 15 volts. The manually-operated electric element of the system is preferably a low voltage, sealed switch. This improves the safety of the device.

If the invention is applied to a conventional vacuum toilet system, in which the emptying and rinsing operation is controlled pneumatically, that is, by means of the atmospheric pressure and the vacuum used in the system, the desired functions can be completely controlled by means of a simple three-way valve that connects suitable pneumatic valve operating devices, which may be of known type, to either atmospheric pressure or to the vacuum source. According to the invention, the three-way valve may be an electrically controlled solenoid valve, the electrical parts of which can easily be very effectively insulated.

The invention is also very well suited for such a solution in which the emptying and rinsing operation of a toilet is activated by non-mechanical devices. For activating the emptying and rinsing operation of a toilet it is known to use a device controlled by an infrared light sensor reacting to the presence of a person. Such a device may be directly connected to a device according to the invention, whereby an automatically working toilet emptying and rinsing system is obtained. The best solution is then that the sensor is arranged to initiate the emptying and rinsing operation only after the user has moved away from the immediate vicinity of the toilet bowl. By this means the risks that are associated with the emptying of a vacuum toilet during use are eliminated.

Irrespective of whether a device according to the invention is mechanical or, for instance, controlled by an infrared light sensor, it is of advantage that the main parts of the control equipment are recessed into a limiting surface of the toilet compartment, preferably into the wall of the compartment, so that only the necessary manually-operated element or the sensor of an automatic system is exposed. Then the device is best protected and insulated from the user.

It is of advantage that the supply of rinse water to the toilet does not cease until some time after the closing of the sewer valve of the toilet. The invention may advantageously be so applied, that the rinse water valve and the sewer valve are connected to the same air duct. A function delay device may then be connected to the rinse water valve, which device delays the closing of the valve for one or a few seconds. If desired, the opening of the rinse water valve may also be delayed correspondingly.

If a device according to the invention is mechanical, that is manually operated, it is of advantage that the activating impulse is arranged to be transmitted to the device by means of a push button element that is large enough that the required movement is obtainable by bending the outer surface element of the push button. The advantage is thereby achieved that the push button may be fully sealed at its edge areas to the limiting surface of the toilet compartment and the necessary movement clearances between the moving parts of the device may be enclosed in a space that is sealed and insulated from the toilet compartment.

The invention also relates to a vacuum sewer arrangement, for instance a vacuum toilet system provided with a control system according to invention.

BRIEF DESCRIPTION OF THE DRAWINGS

The invention will now be described in greater detail with reference to the accompanying drawings, in which:

FIG. 2 shows a connection diagram of an air pressure controlled vacuum toilet according to the invention, FIG. 3 shows a connection diagram of a sensor controlled vacuum toilet according to invention.

DETAILED DESCRIPTION

Figure 1:
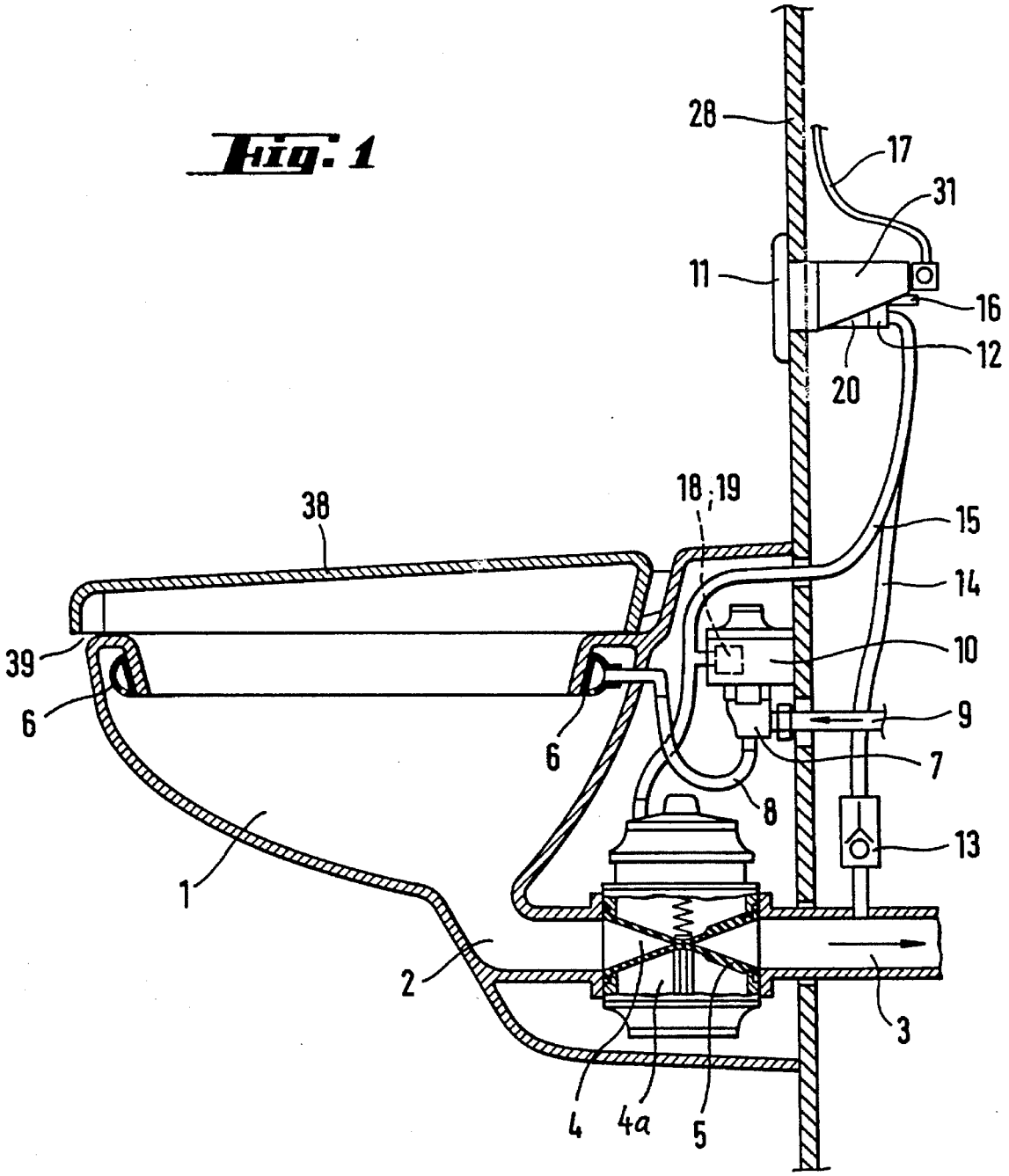
FIG. 1 schematically shows a vacuum toilet according to the invention.

In the drawings, 1 indicates a toilet bowl, 2 the outlet duct of the toilet bowl and 3 a vacuum sewer pipe connected to the toilet bowl immediately downstream of the outlet duct 2. The normal vacuum level in the vacuum sewer is about 50% of atmospheric pressure. Between the toilet bowl 1 and the sewer pipe 3 there is a normally closed sewer valve 4, in which the flow duct is formed by a rubber pipe 5, which is normally kept in the compressed or closed position shown in FIG. 1 by means of a pressure difference and mechanical elements. The sewer valve 4 may be of the type disclosed in U.S. Pat. No. 3,984,080, hereby incorporated by reference. A valve actuator 4a controls operation of the sewer valve.

At the upper edge of the toilet bowl 1 there is a rinse water ring 6 made of elastic material. The rinse water ring receives water from a rinse water valve 7 through a hose 8. The rinse water valve 7 is normally closed and is connected by a pipe 9 to a suitable pressurized water supply system. The operation of the valve is controlled by an actuator 10 that when connected to a vacuum source becomes activated and opens the valve 7. The valves 4 and 7 are biased towards a closed position and stay closed when their actuators are under atmospheric pressure, but open when the actuators are under the influence of vacuum.

The emptying and rinsing operation of the toilet is initiated by pressing a push button or pad 11 that is part of an electrical control device 31. The electrical control device 31 is sealed against humidity and is protected against unauthorized human access. The button 11 controls a solenoid operated three-way valve 12 by means of which both the sewer valve actuator 4a and the rinse water valve actuator 10 can be put under the influence of vacuum by connecting to the sewer 3 through a check valve 13. The button 11 constitutes a human-responsive activation element that initiates the emptying and rinsing operation. The three-way valve 12 is connected to the vacuum sewer 3 through a hose 14. In a first control position of the three-way valve 12, the hose 14 is connected through the three-way valve to a hose 15 that leads to the actuator 10 of the rinse water valve 7 as well as to the actuator 4a of the sewer valve 4. In a second control position of the three-way valve 12, the flow duct leading to hose 14 is closed and the hose 15 is connected through a duct 16 to the atmosphere, which eliminates the vacuum operating the valves 4 and 7. In the first control position of the valve 12, the actuator 10 and the actuator 4a are then put under the influence of vacuum and the rinse water valve and the sewer valve are actuated to open position, whereas in the second control position the valves 4 and 7 close. Thus, the system shown in FIG. 1 makes it possible to open and close both the sewer valve 4 and the rinse water valve 7 by setting the three-way valve in a position that connects the hose 15 selectively either to a vacuum source or to the atmosphere.

The toilet bowl may be provided with a cover 38 schematically shown in FIG. 1. It is necessary for the emptying and rinsing operation of the toilet bowl that the sewage removed through the outlet duct 2 be followed by a considerable amount of air, normally of a volume about 15 times larger than the volume of the sewage discharged from the toilet in one batch. Therefore, when the cover is closed the interior of the bowl 1 must be in connection with the atmosphere, for instance through an air slot 39 between the bowl 1 and the cover 38, allowing air to flow into the bowl. Alternatively some other suitable duct that always stays open may be provided. The cross sectional area of such a duct should be at least 10 $cm^2$ and preferably at least 13 $cm^2$, but it is recommended that it be considerably larger.

In FIG. 2 the most important elements of a pneumatic and electric circuit diagram of the vacuum toilet arrangement of FIG. 1 are shown. The actuator 10 of the rinse water valve 7 is provided with a throttling device 18 and a check valve 19. These are connected in parallel. The check valve 19 allows the air to flow quickly out from the actuator 10, but the air flow into the actuator takes place more slowly, because flow is possible only through the throttling device 18. As a result of this the actuator 10 can quickly be put under vacuum, so that the valve 7 opens quickly, whereas the vacuum is eliminated more slowly, which delays closing of the valve 7, so that it closes slightly after the closing of the sewer valve 4.

A high voltage electric circuit 37 is connected between electric cables 17 of a conventional electrical supply network that supplies current at a voltage of over 15 volts and possibly 100 volts or higher. The circuit 37 includes the primary winding of a transformer 24 and the solenoid 20 of the three-way valve 12. The solenoid 20 is connected in series with a relay switch 21. The relay switch 21 is operated by means of an electric actuator 22 that is connected in a low voltage circuit 23 that includes the secondary winding of the transformer 24, in which the voltage is preferably about 7.5 volts. The push button 11 of the system operates an electrical switch 25 that closes the low voltage circuit 23. This causes the actuator 22 to close the switch 21, which connects the solenoid 20 of the three-way valve 12 through the cables 17 to the electrical supply network. The solenoid 20 then moves the three-way valve 12 into a position that connects the duct 14 to the duct 15, thereby opening the valves 7 and 4.

Several other function controlling devices may be included in the illustrated electric control system. Useful additional devices are normally a timer that determines the duration of the emptying and rinsing operation of the toilet and other timing control devices, alarm and correction equipment activated by malfunctions, a device protecting against a too quick restart of the emptying and rinsing operation, etc. These devices are not shown, because their use and function are well known.

FIG. 3 shows important parts of a circuit diagram of a completely electrically controlled and automatically operating device for the emptying and rinsing of a vacuum toilet system. The sewer valve 4 is in this embodiment, for instance, a mechanical closure valve with an electrical actuator according to U.S. Pat. No. 4,713,847, hereby incorporated by reference. Also the entire water feed system, including an electrically controlled rinse water valve 7, may be designed according to the disclosure in that patent. In the device of FIG. 3 there is an electrical control unit 33, to which an infrared sensor 26 is connected. The electrical control unit 33 is sealed against humidity and is protected against unauthorized human access. The sensing region of the infrared sensor is shown as a sector 27. The control unit 33 includes components necessary for the control of the function of the device, for instance as disclosed in U.S. Pat. No. 4,713,847, or in some other suitable way. The sensor 26 may be directly connected to the control unit, so that the signals it transmits control the function of the device in a desired way. It is preferred that the sensor 26 controls the function of the device so that the emptying and rinsing of the toilet bowl starts only after the user has moved away from the immediate vicinity of the toilet bowl.

The infrared sensor 26 shown in FIG. 3 or any equivalent device may also be used in a system according to FIG. 2 in such a way that the sensor controls the position of the electric switch 21 so as to obtain the desired function. The electric connections needed for this are known per se.

Figure 4:
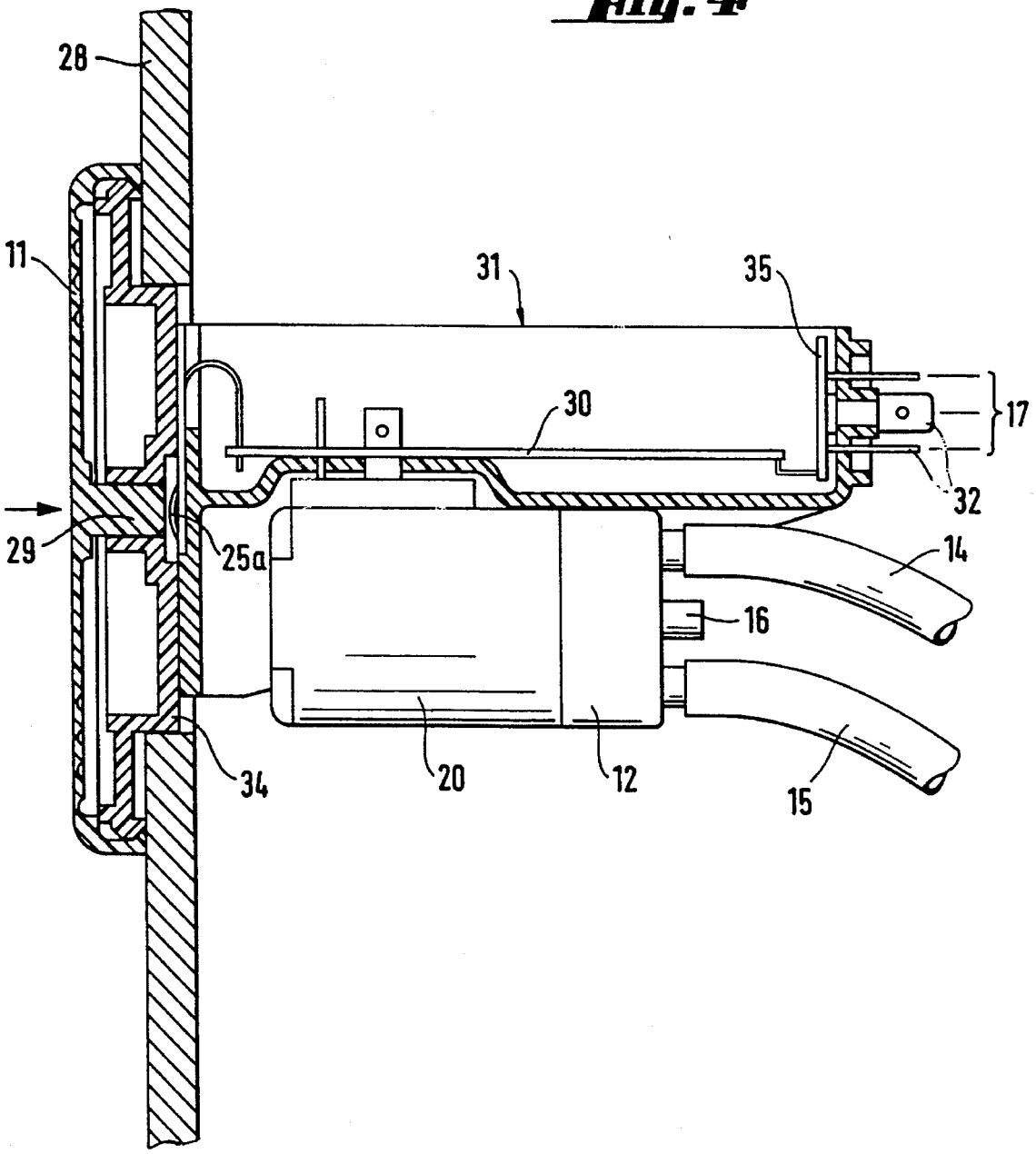
FIG. 4 shows in section a manual electrical control device according to the invention.

In FIG. 4 the structure of the push button of a system according to FIG. 1 and the elements connected thereto are shown. The front wall of the push button 11 consists of a large flexible diaphragm that may be of generally square shape and of an overall size of about 10×10 cm or a round element of corresponding size. The push button 11 is mounted to the wall of the toilet compartment by means of a mounting body 34 fitted in an aperture in the wall 28. In the middle of the push button 11 there is formed, as an integral element of the diaphragm, a guide pin 29 that slides in a bore formed in the body 34 and directly operates a membrane switch 25*a*, equivalent to the switch 25 of the circuit diagram of FIG. 2. The membrane switch may be of known form, comprising a plastic membrane that is deflected to close the switch 25. The edge area of the push button may be in sealed connection with the wall 28 of the toilet compartment, because the function movement of the push button takes place by bending the large front wall of the button.

The construction of the push button 11 and the use of the push button to operate the membrane switch provides a double seal between the interior space of the toilet compartment and the switch 25. The electric circuit 23 controlled by the membrane switch 25*a* (FIG. 2) is incorporated in an electronic circuit card 30 that is completely surrounded by resin or other insulating material (not shown) in the casing of an electric control device 31. At the connection points 32 of the electrical supply network 17 there is another circuit card 35 that is so connected to the circuit card 30, that the solenoid 20 of the three-way valve 12 is energized in the desired way when the button 11 is operated, whereby the solenoid 20 sets the three-way valve 12 in a position interconnecting the hoses 14 and 15. In the deenergized position of the solenoid 20 the three-way valve 12 takes a position that connects the hose 15 to the atmosphere through a nozzle 16. It will therefore be seen that all the electrical components for controlling supply of operating current to the solenoid valve 12 from the electrical supply network are incorporated in a single operation unit, namely the electrical control device 31, having terminals connected to the supply network.

The push button 11, the mounting body 34 and the casing of the electric control device 31 are of plastic or other suitable material that does not conduct electricity.

The invention is not limited to the embodiments shown, but several modifications thereof are feasible within the scope of the attached claims.

We claim:

1. A vacuum sewer toilet system comprising a toilet compartment, a toilet bowl installed in the toilet compartment, a vacuum sewer, a rinse water supply valve for controlling supply of rinse water to the toilet bowl, a sewer valve connecting the toilet bowl to the vacuum sewer, vacuum activated actuators for the rinse water supply valve and the sewer valve respectively, a human-responsive activation element for selectively communicating partial vacuum or ambient pressure to a port of the activation element, an air duct connecting the actuator for the sewer valve to said port of the activation element, and a delay device connected between said air duct and the actuator for the rinse water supply valve for impeding flow of air from the actuator for the rinse water supply valve to the air duct, whereby closing of the rinse water supply valve is delayed slightly relative of closing of the sewer valve.

2. A system according to claim 1, wherein the activation element communicates partial vacuum to the port of the activation element when activated and communicates atmospheric pressure to the port of the activation element when the activation element is not activated.

* * * * *